US006018968A

United States Patent [19]

Sides

[11] Patent Number: 6,018,968

[45] Date of Patent: Feb. 1, 2000

[54] LOCKING APPARATUS

[76] Inventor: Kenneth W. Sides, 3105 Montreal Dr., Baton Rouge, La. 70819

[21] Appl. No.: 09/169,158

[22] Filed: Oct. 9, 1998

[51] Int. Cl.[7] ..... E05B 13/00

[52] U.S. Cl. ..... 70/14; 70/18; 70/199; 70/211; 70/DIG. 65; 292/288

[58] Field of Search ..... 70/14, 18, 19, 70/199, 200, 211, 212, DIG. 65, 159, 163, 198, 202, 203; 292/258, 288

[56] References Cited

U.S. PATENT DOCUMENTS

| | | | |
|---|---|---|---|
| 924,824 | 6/1909 | Peeble . | |
| 1,475,863 | 11/1923 | Pate | 70/199 |
| 1,850,602 | 3/1932 | Pineo . | |
| 2,151,587 | 3/1939 | Cassileth | 292/288 |
| 3,926,018 | 12/1975 | Joersz | 70/19 |
| 4,082,334 | 4/1978 | Volta et al. | 292/288 |
| 4,146,242 | 3/1979 | Bose | 70/58 X |
| 4,216,665 | 8/1980 | McKelvey | 70/58 |
| 4,299,361 | 11/1981 | Webb | 70/18 X |
| 4,372,136 | 2/1983 | Michelson | 70/14 |
| 5,027,622 | 7/1991 | Hatch et al. | 70/14 |
| 5,259,220 | 11/1993 | Fredrickson | 70/14 |
| 5,294,160 | 3/1994 | Arthur | 292/258 |
| 5,501,493 | 3/1996 | Arthur | 292/258 |
| 5,709,422 | 1/1998 | Malone | 292/288 |

FOREIGN PATENT DOCUMENTS

| | | | |
|---|---|---|---|
| 602103 | 3/1926 | France | 70/200 |
| 146738 | 7/1920 | United Kingdom | 70/18 |
| 648598 | 1/1951 | United Kingdom | 70/14 |

*Primary Examiner*—Lloyd A. Gall
*Attorney, Agent, or Firm*—David L. Ray

[57] ABSTRACT

A locking apparatus for dual adjacent doors and for a hasp. The locking apparatus of the invention includes a first locking bar connected by a hinge to a second locking bar, the first and second locking bar each having a pair of longitudinally spaced openings therein, the pair of openings in the first locking bar being aligned with the pair of openings on the second locking bar when the first locking bar is pivoted to contact the second locking bar, the first locking bar and the second locking bar being secured to each other by a lock located at the ends of the locking bars opposite the ends of the locking bars at which the hinge is located.

1 Claim, 6 Drawing Sheets

LOCKING APPARATUS

BACKGROUND OF THE INVENTION

1. Field of the Invention

The present invention relates to locking apparatus. In particular, the present invention relates to locking apparatus for locking dual adjacent doors and for connection to the staple of a hasp.

2. Description of the Prior Art

Dual adjacent doors are common in homes, offices, and other buildings, and are sometimes referred to as "French Doors". Such doors present a pleasant esthetic appearance and allow access for large objects or large numbers of people to be introduced into the home or other building through the dual adjacent doors. Such doors commonly have adjacent door knobs for unlocking and locking the doors.

It is well known in the art that such dual adjacent doors represent a security risk because they can be easily forced open. Dual adjacent doors which have dead bolts therein can still be easily forced open because the doors separate from each other when forced open, thereby permitting a dead bolt to be more easily pulled outwardly from an adjacent door when force is placed thereon.

Security devices for locking dual adjacent and other similar items are well known in the art. The following U.S. Patents are exemplary of the prior art: U.S. Pat. Nos. 924,824; 1,850,602; 2,151,587; 3,926,018; 4,082,334; 4,372,136; 5,294,160; 5,501,493 and 5,709,422.

SUMMARY OF THE INVENTION

In accordance with the present invention there is provided a locking apparatus for dual adjacent doors and for a hasp. The locking apparatus of the invention includes a first locking bar connected by a hinge to a second locking bar, the first and second locking bar each having a pair of longitudinally spaced openings therein, the pair of openings in the first locking bar being aligned with the pair of openings on the second locking bar when the first locking bar is pivoted to contact the second locking bar, the first locking bar and the second locking bar being secured to each other by a lock located at the ends of the locking bars opposite the ends of the locking bars at which the hinge is located.

The present invention has the advantage of securely holding two dual adjacent doors having adjacent door handles in a locked position when the invention is placed over each of the adjacent handles of the dual adjacent doors.

The present invention has the additional advantage of being placeable on the outside of the dual adjacent doors and locked thereon to prevent removal by an unauthorized person not having a key to the lock.

The present invention has the advantages of being useful as a lock to secure the hinged slotted part of a hasp over the staple associated with the hasp and being incapable of being cut by a bolt cutter.

DESCRIPTION OF THE PREFERRED EMBODIMENTS

Figure 2:
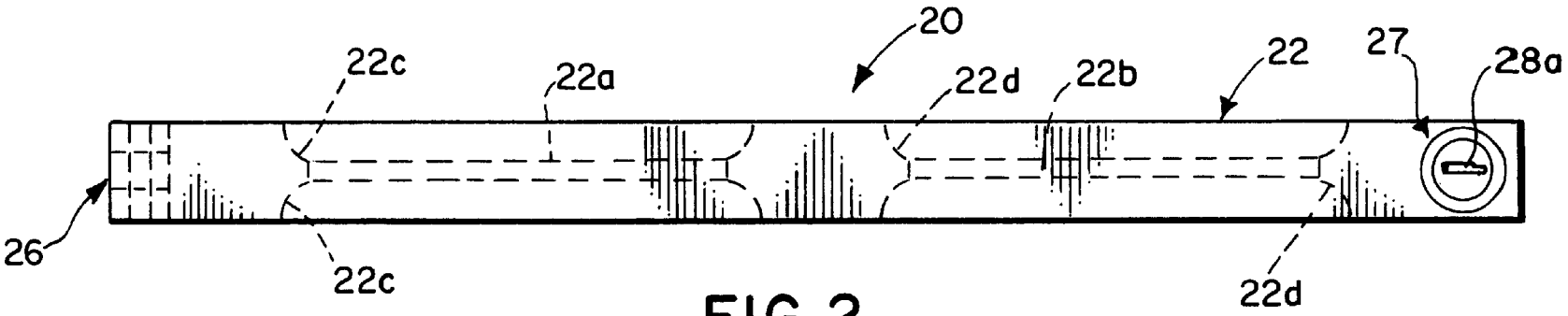
FIG. 2 is a top view of the locking apparatus of FIG. 1.

Referring now to the drawings, and in particular FIGS. 1 through 10, the locking apparatus of the invention is generally indicated by the numeral 20. Locking apparatus 20 has two locking bars generally indicated by the numerals 22 and 24 which are joined by a hinge generally indicated by the numeral 26.

Hinge 26 has a pivot pin 26*a* about which locking bar 22 and locking bar 24 pivot. Pivot pin 26*a* is received in two spaced apart arms 26*b*—26*b* which extend downward from locking bar 22. Pivot pin 26*a* is rotatably received in arm 26*c* which extends upward from locking bar 24.

Figure 1:
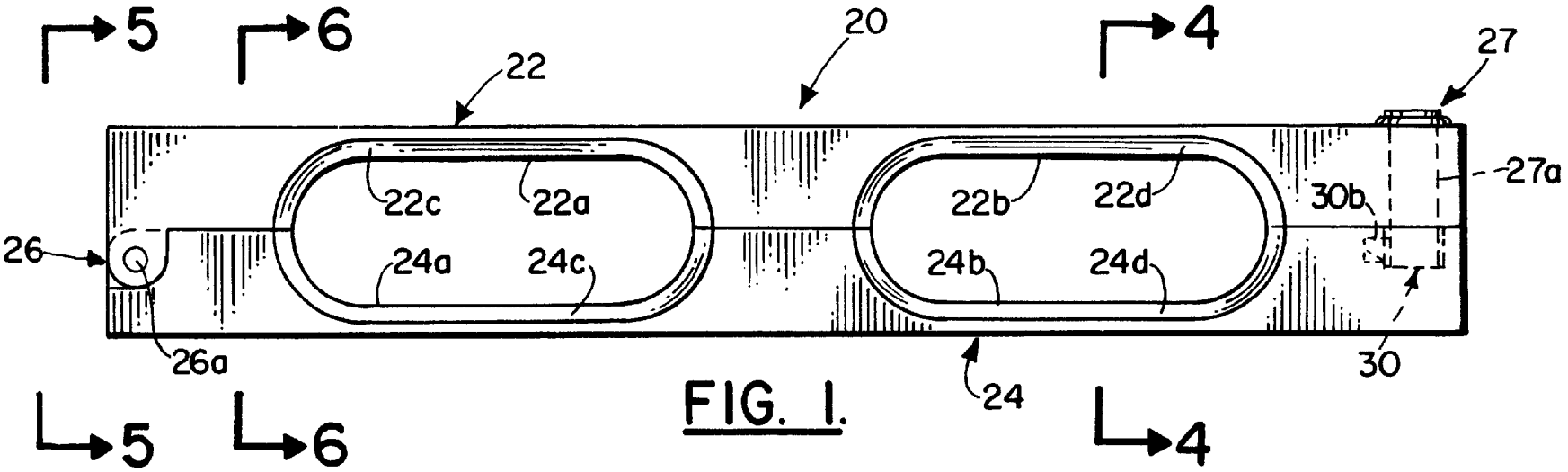
FIG. 1 is a plan view of the locking apparatus of the invention.
Figure 7:
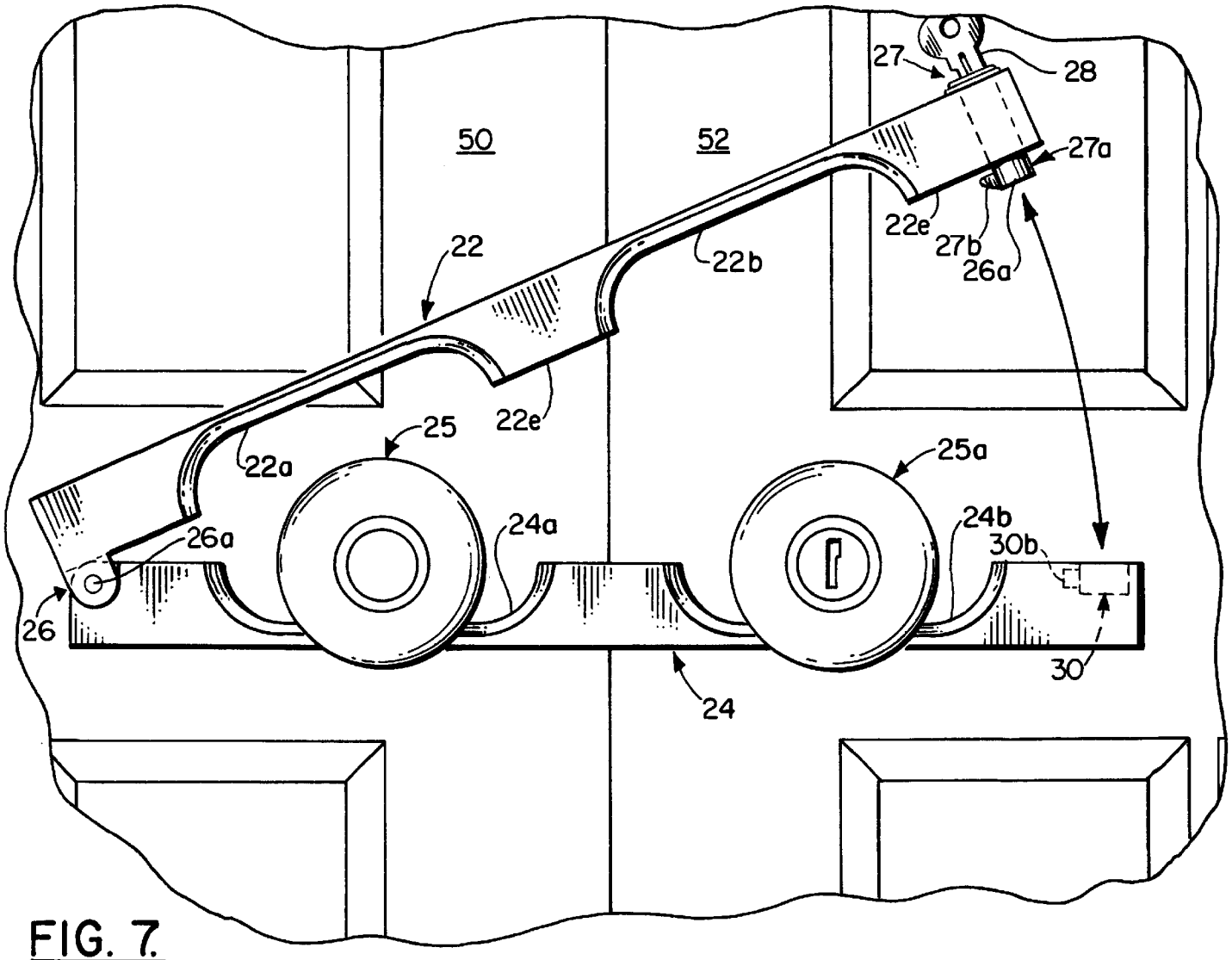
FIG. 7 is a schematic, partially cut-away plan view of the locking apparatus of the invention aligned for placement over the adjacent door knobs of dual adjacent doors and having a key inserted in the key-operated lock of locking bar 22.

Locking bar 22 has a pair of longitudinally spaced openings 22*a* and 22*b*, and locking bar 24 has a pair of longitudinally spaced openings 24*a* and 24*b*. Openings 22*a* and 24*a* align with each other for receipt of one of two adjacent doorknobs such as doorknob 25 in FIG. 7 when locking bar 22 is pivoted into contact with locking bar 24 as shown in FIGS. 1 and 7, and openings 22*b* and 24*b* align with each other for receipt of one of two adjacent doorknobs such as doorknob 25*a* in FIG. 7 when locking bar 22 is pivoted into contact with locking bar 24 as shown in FIGS. 1 and 7.

Figure 8:
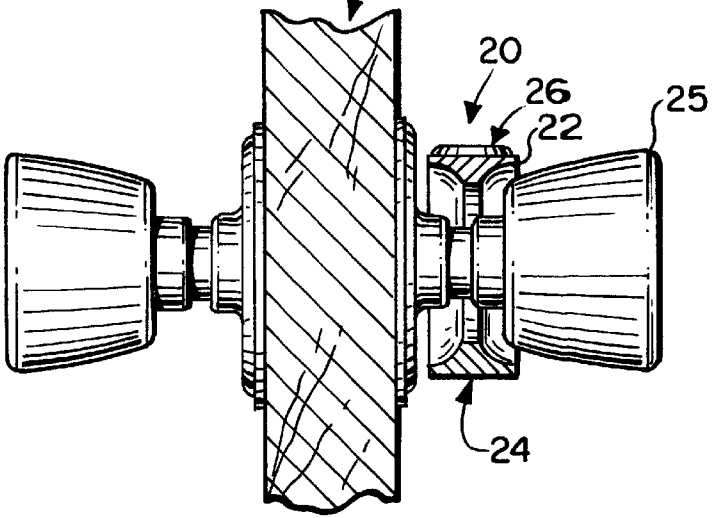
FIG. 8 is a cross-sectional view of the locking device of the invention secured to the adjacent door knobs of dual adjacent doors.

Preferably, all openings 22*a*, 22*b*, 24*a* and 24*b* have beveled outer edges 22*c*, 22*d*, 24*c* and 24*d*, respectively. The beveled outer edges preferably receive the smaller diameter inner portion of a typical doorknob 25 therein as shown in FIGS. 7 and 8. All openings 22*a*, 22*b*, 24*a* and 24*b* are sufficiently small in size to prevent doorknobs 25 or 25*a* from passing therethrough.

Locking bar 22 has a key-operated lock generally indicated by the numeral 27 connected thereto to selectively lock locking bar 22 to locking bar 24. Key-operated lock 27 may be any key-operated lock known in the art. As can be seen in FIGS. 1–3 and 7–8, lock 27 has a cylinder 27*a* which extends through locking bar 22 and downward from the inner face 22*e* of locking bar 22. Cylinder 27*a* has a conventional spring-loading movable pin 27*b* therein which is withdrawn into cylinder 27*a* when key 28 is inserted into keyhole 28*a* in cylinder 27*a*, as shown in FIG. 7, and rotated from the position shown in FIG. 7.

Figure 3:
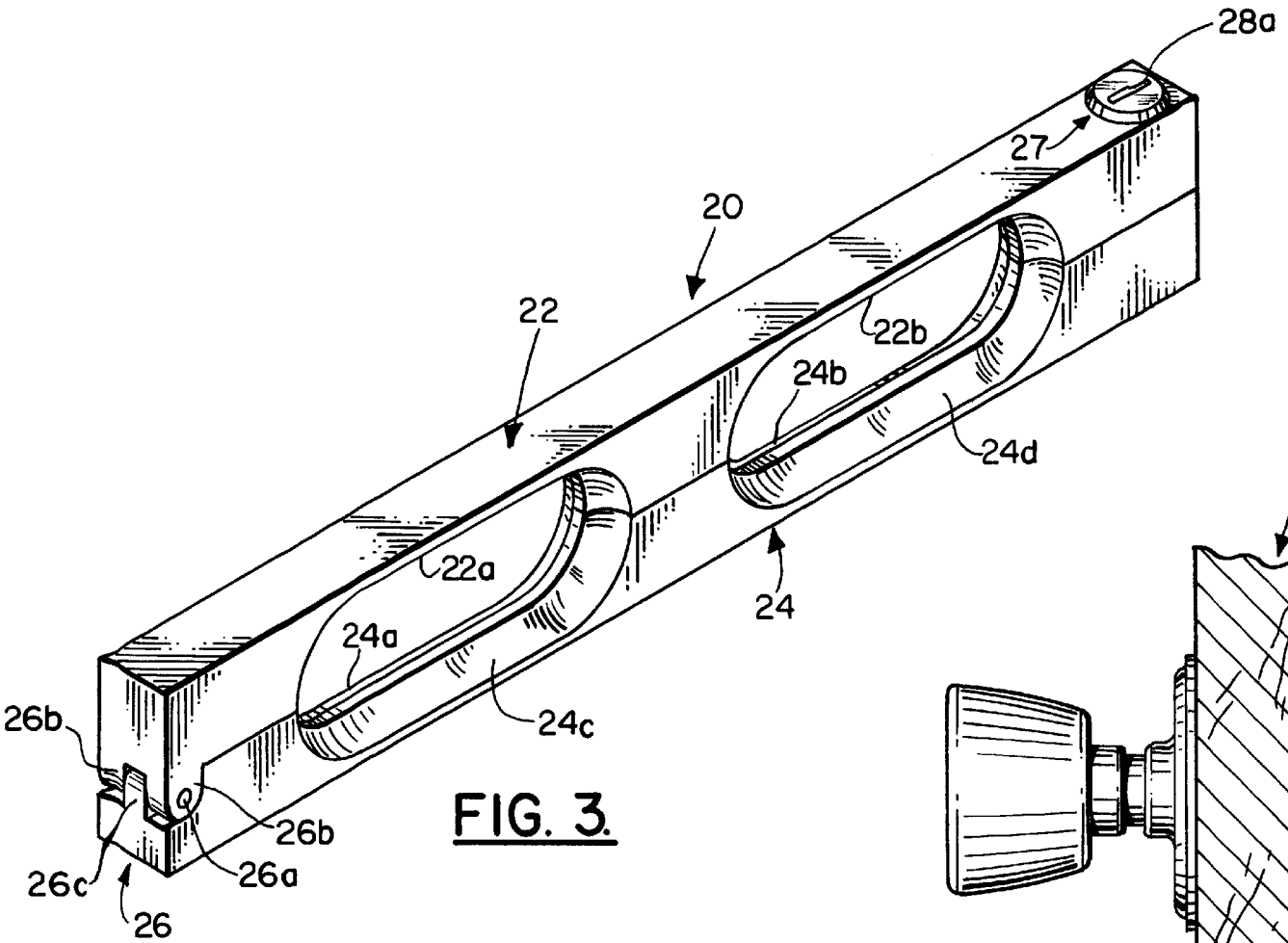
FIG. 3 is a perspective view of the locking apparatus of the invention.
Figure 4:
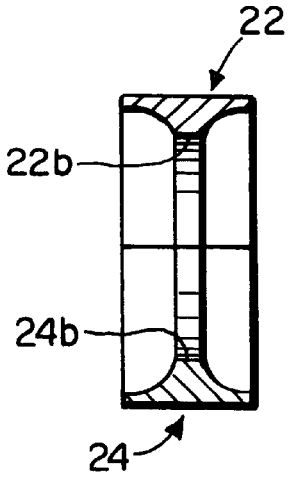
FIG. 4. is a cross-sectional view taken along lines 4—4 of FIG. 1.
Figure 5:
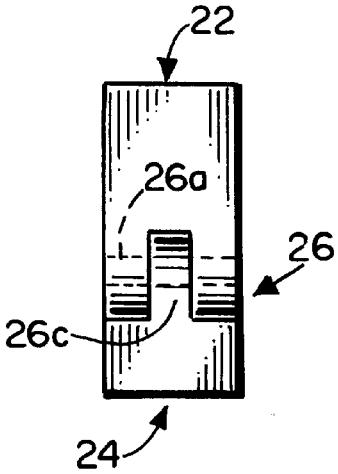
FIG. 5 is an end view taken along lines 5—5 of FIG. 1.
Figure 6:
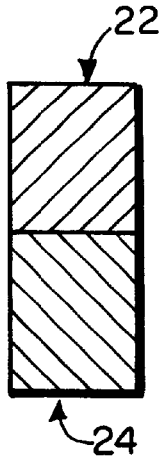
FIG. 6 is a cross-sectional view taken along lines 6—6 of FIG. 1.

The portion of cylinder 27*a* extending beneath the inner face 22*e* of locking bar 22 is received in the cavity generally indicated by the numeral 30 in locking bar 24. When locking bar 22 is pivoted into contact with locking bar 24 as shown in FIGS. 1 and 3, the portion of cylinder 27*a* extending from the inner face 22*e* of locking bar 22 is forced into cavity 30 and movable pin 27*b* is forced into cavity 30. When movable pin 27*b* reaches the cavity 30*b* adjacent to cavity 30, spring loaded movable pin 27*b* moves into cavity 30*b* to lock locking bar 22 to locking bar 24.

Figure 9:
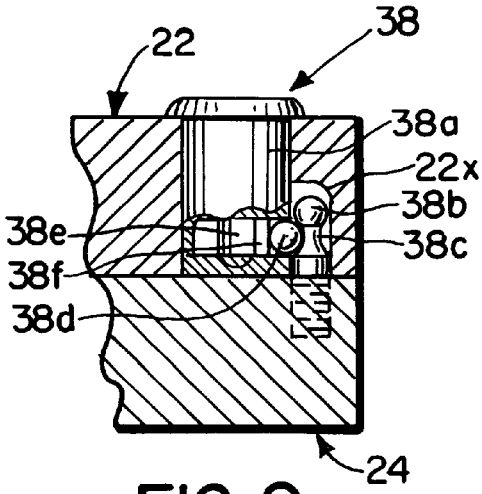
FIG. 9 is a detailed view of a first alternate embodiment of the key-operated lock utilized with the locking apparatus of the present invention.
Figure 10:
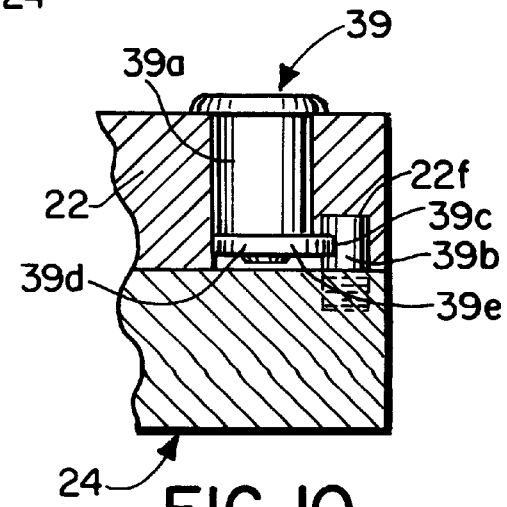
FIG. 10 is a detailed view of a second alternate embodiment of the key-operated lock of the locking apparatus of the present invention.

Any conventional key-operated lock may be substituted for lock 27. Alternates for lock 27 are shown in FIGS. 9 and 10. The lock 38 shown in FIG. 9 and the lock 39 shown in FIG. 10 are locks which are well known in the art.

As can be seen in FIG. 9, lock 38 utilizes a cylinder 38*a* similar to cylinder 27*a*. A post or boss 38*b* having concave shoulders 38*c* extending therearound is rigidly connected to locking bar 24 and extends upward therefrom into cavity 22*x*. Spherical ball 38*d* connected to the inner rotating portion of cylinder 38*a* rotates when a key is inserted therein and rotated. Spherical ball 38*d* is connected to shoulder 38*f*. Lock 38 locks locking bar 22 to locking bar 24 in the position shown in FIG. 9. When a key is inserted into lock 38 and rotated in the appropriate direction, ball 38*d* is rotated away from shoulders 38*c* and locking bar 22 is unlocked from locking bar 24.

Lock 39 is similar to a conventional file cabinet lock. As can be seen in FIG. 10, lock 39 utilizes a cylinder 39*a* similar to cylinder 27*a*. A post or boss 39*b* having a notch or groove 39*c* therein is rigidly connected to locking bar 24 and extends upward therefrom into cavity 22*f*. Arm 39*d* is connected to the inner rotating portion of cylinder 39*a*. Arm 39*d* has a tip 39*e* and both rotate when a key is inserted therein and rotated. Tip 39*e* is received in notch or groove 39*c* to lock locking bar 22 to locking bar 24 in the position shown in FIG. 10. When a key is inserted into lock 39 and rotated in the appropriate direction, tip 39*e* is rotated away from notch or groove 39*c* and locking bar 22 is unlocked from locking bar 24.

Referring now to FIG. 7, to place the locking apparatus 20 on the doorknobs 25 and 25*a* of two adjacent doors 50 and 52, locking bar 22 is unlocked from locking bar 24 and pivoted upward from locking bar 22 about hinge 26 as shown by the arrow in FIG. 7. Locking bar 24 is aligned with the doorknobs 25 and 25*a* as shown in FIG. 7, and locking bar 22 is closed onto doorknobs 25 and 25*a* and locking bar 24 by rotating locking bar 22 downward in the direction of the arrow in FIG. 7 until lock 27 is received and locked to locking bar 24. Thus, doors 50 and 52 are prevented from being opened since doorknobs 25 and 25*a* cannot pass through locking apparatus 20 when a person attempts to open doors 50 and 52.

Figure 15:
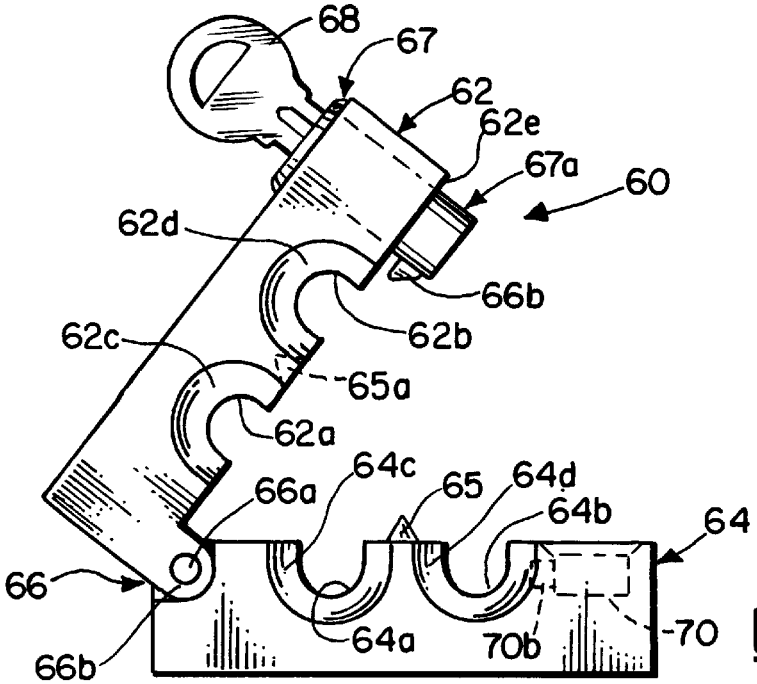
FIG. 15 is a plan view of the second embodiment of the locking apparatus of the invention in the open position and having a key inserted in the key operated lock of the locking apparatus of the invention.
Figure 16:
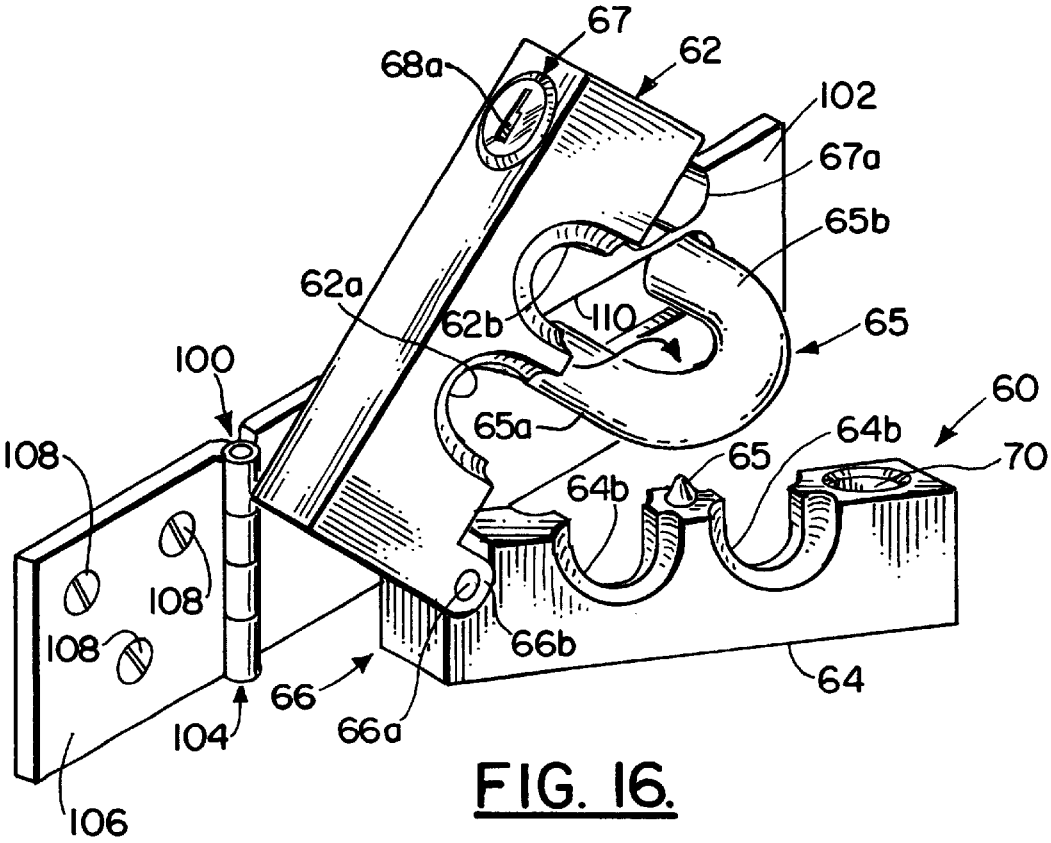
FIG. 16 is a perspective view of the second embodiment of the locking apparatus of the invention in the open position aligned for placement upon the staple of a hasp.
Figure 17:
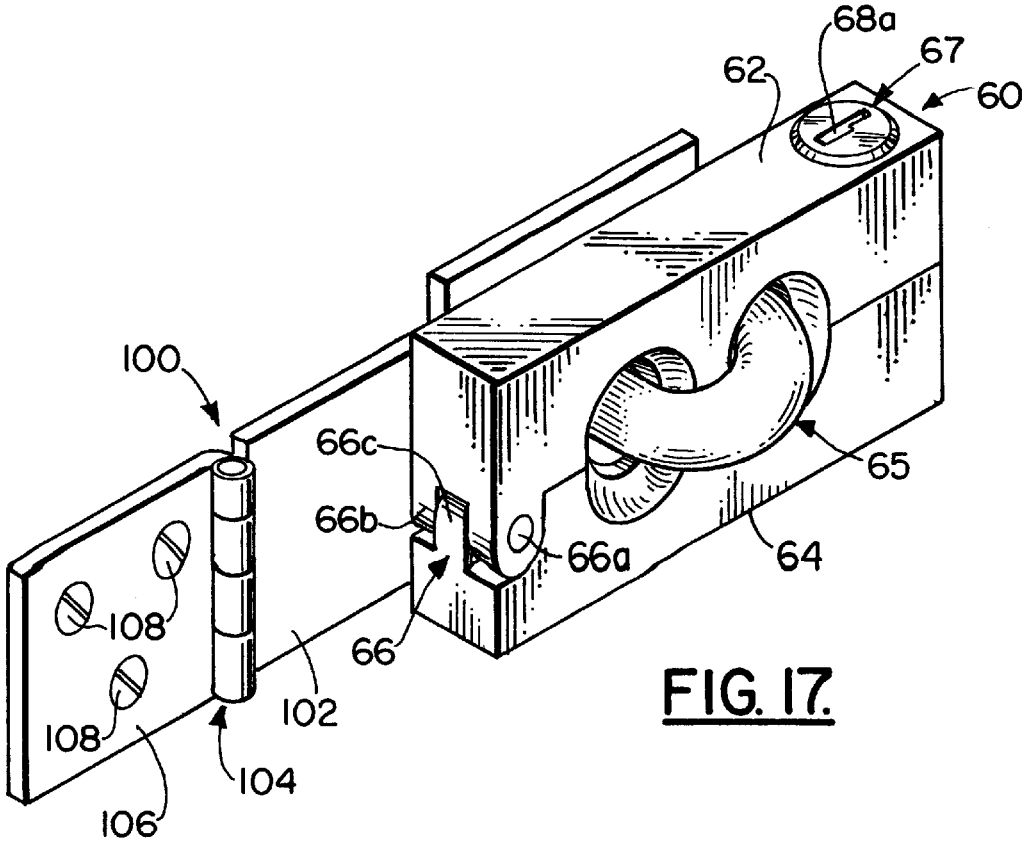
FIG. 17 is a perspective view of the second embodiment of the locking apparatus of the invention shown locked upon the staple of a hasp.

Referring now to FIGS. 11–16, there is shown a second embodiment of the locking apparatus of the invention generally indicated by the numeral 60 for placement on a hasp generally indicated by the numeral 100 shown in FIGS. 16 and 17. Hasp 100 is a conventional hasp well known in the art having a generally rectangular tongue 102 which is connected by a hinge 104 to a plate 106. Plate 106 may be rigidly connected to a door (not shown) or gate or the like by screws 108, or bolts, nails or other fasteners. Tongue 102 has an elongated slot 110 therein for receipt of a U-shaped staple generally indicated by the numeral 65. U-shaped staple 65 is rigidly connected to a doorjamb (not shown), gate post, or the like.

Tongue 102 is commonly fastened to staple 65 by a padlock as is well known in the art. However, a padlock may be easily removed from a staple by cutting the U-shaped bar connected to the padlock with a conventional bolt-cutter.

Locking apparatus 60 has two locking bars generally indicated by the numerals 62 and 64 which are joined by a hinge generally indicated by the numeral 66.

Hinge 66 has a pivot pin 66*a* about which locking bar 62 and locking bar 64 pivot. Pivot pin 66*a* is received in two spaced apart arms 66*b*–66*b* which extend downward from locking bar 62. Pivot pin 66*a* is rotatably received in arm 66*c* which extends upward from locking bar 64.

Locking bar 62 has a pair of longitudinally spaced openings 62*a* and 62*b*, and locking bar 64 has a pair of longitudinally spaced openings 64*a* and 64*b*. Openings 62*a* and 64*a* align with each other for receipt of one of two adjacent parallel portions 65*a* of U-shaped staple 65 as shown in FIGS. 16 and 17, and openings 62*b* and 64*b* align with each other for receipt of one of two adjacent parallel portions 65*b* of U-shaped staple 65 as shown in FIGS. 16 and 17. Preferably, all openings 62*a*, 62*b*, 64*a* and 64*b* have beveled outer edges 62*c*, 62*d*, 64*c* and 64*d*, respectively.

Figure 11:
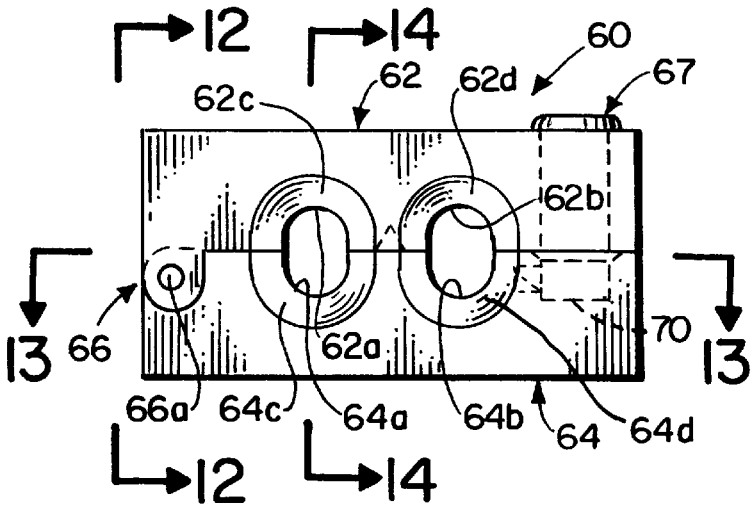
FIG. 11 is a plan view of a second embodiment of the locking apparatus of the invention.
Figure 12:
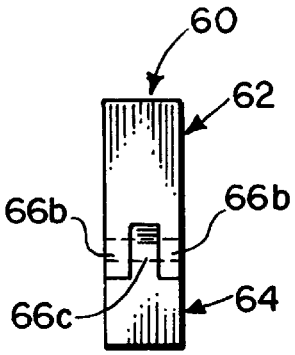
FIG. 12 is an end view of the second embodiment of the invention shown in FIG. 11 taken along lines 12—12.
Figure 13:
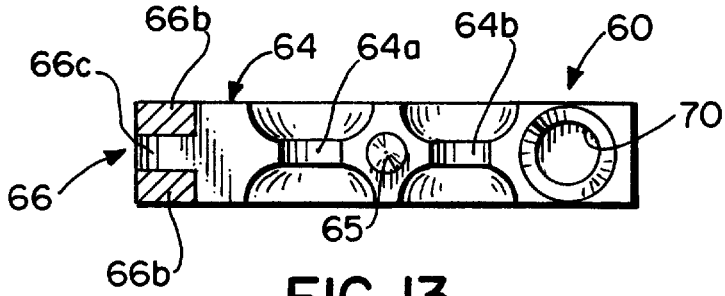
FIG. 13 is a view of the second embodiment of the locking apparatus of the invention taken along lines 13—13 of FIG. 11.
Figure 14:
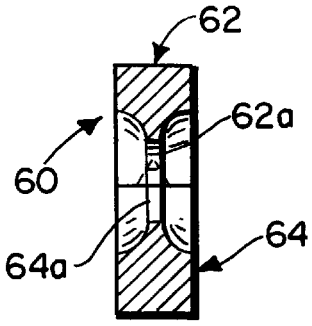
FIG. 14 is a cross sectional view of the second embodiment of the locking apparatus of the invention taken along lines 14—14 of FIG. 11.

Locking bar 62 has a key-operated lock generally indicated by the numeral 67 connected thereto to selectively lock locking bar 62 to locking bar 64. Key-operated lock 67 may be any key operated lock known in the art. As can be seen in FIGS. 11, 15, and 17, lock 67 has a cylinder 67*a* which extends through locking bar 62 and downward from the inner face 62*e* of locking bar 62. Cylinder 67*a* has a conventional spring-loading movable pin 66*b* therein which is withdrawn into cylinder 67*a* when key 68 is inserted into keyhole 68*a* in cylinder 67*a*, as shown in FIG. 15, and rotated from the position shown in FIG. 15.

The portion of cylinder 67*a* extending beneath the inner face 62*e* of locking bar 62 is received in the cavity generally indicated by the numeral 70 in locking bar 64. When locking bar 62 is pivoted into contact with locking bar 64 as shown in FIGS. 11 and 17, the portion of cylinder 67*a* extending from the inner face 62*e* of locking bar 62 is forced into cavity 70 and movable pin 66*b* is forced into cavity 70. When movable pin 66*b* reaches the cavity 70*b* adjacent to cavity 70, spring loaded movable pin 66*b* moves into cavity 70*b* to lock locking bar 62 to locking bar 64.

Locking bar 64 preferably has a pin 65 which is received in a cavity 65*a* in locking bar 62 to aid in alignment of locking bar 62 and 64 in the closed position shown in FIG. 11.

Referring now to FIG. 16, to place the locking apparatus 60 on U-shaped staple 65 of hasp 100, locking bar 62 is unlocked from locking bar 64 and pivoted upward from locking bar 62 about hinge 66 as shown in FIG. 16. Locking bar 64 is aligned with the adjacent parallel portions 65*a* and 65*b* of staple 65 as shown in FIG. 16, and locking bar 62 is closed onto staple 65 and locking bar 64 by rotating locking bar 62 downward as shown in FIG. 17 until lock 67 is received and locked to locking bar 64. Thus, tongue 102 is locked to staple 65. Whereas a padlock can be easily removed from staple 65 by cutting the U-shaped bar connected to the padlock with a conventional bolt-cutter, the locking apparatus 60 cannot be removed from staple 65 by a bolt cutter and is thus a more secure lock for a hasp.

Although the preferred embodiments of the invention have been described in detail above, it should be understood that the invention is in no sense limited thereby, and its scope is to be determined by that of the following claims:

What is claimed is:

1. A locking apparatus for securing two adjacent doorknobs of two adjacent doors together to lock said doors comprising a first locking bar connected at one end by a hinge to one end of a second locking bar, said first locking bar and said second locking bar each having an outer face and an inner face, said first and said second locking bar each having a pair of beveled longitudinally spaced openings on said inner faces thereof for receipt of said adjacent doorknobs, the beveled portion of said longitudinally spaced openings being adapted to partially receive the inner portion of said doorknob, said pair of openings in said first locking bar being aligned with said pair of openings in said second locking bar when said first locking bar is pivoted about said hinge to contact said second locking bar, said first locking bar and said second locking bar being secured to each other by a key-operated lock located at the ends of said first locking bar and said second locking bar opposite the ends of said first locking bar and said second locking bar at which said hinge is located, said lock having a cylinder for receiving a key to operate said lock, said cylinder being rigidly connected to said first locking bar, said cylinder extending completely through and out of said inner face of said first locking bar, said second locking bar having a cavity on the inner face thereof extending partially therethrough for locking receipt of the entire portion of said cylinder extending out of the inner face of said first locking bar.

* * * * *